United States Patent [19]

Kruse et al.

[11] Patent Number: 4,587,031

[45] Date of Patent: May 6, 1986

[54] PROCESS FOR THE PRODUCTION OF TABLET FORM DETERGENT COMPOSITIONS

[75] Inventors: Hans Kruse, Korschenbroich; Martin Witthaus; Theodor Altenschöpfer, both of Duesseldorf; Klaus Schumann, Erkrath, all of Fed. Rep. of Germany

[73] Assignee: Henkel Kommanditgesellschaft auf Aktien, Duesseldorf, Fed. Rep. of Germany

[21] Appl. No.: 598,626

[22] Filed: Apr. 10, 1984

[30] Foreign Application Priority Data

May 2, 1983 [DE] Fed. Rep. of Germany ..... 3315950

[51] Int. Cl.[4] ..... C11D 17/00

[52] U.S. Cl. ..... 252/135; 252/99; 252/156; 252/174; 252/186.35; 252/DIG. 16

[58] Field of Search ..... 252/99, 135, 156, 174, 252/186.35, DIG. 16

[56] References Cited

U.S. PATENT DOCUMENTS

| | | | |
|---|---|---|---|
| 2,882,243 | 4/1959 | Milton | 252/455 |
| 2,882,244 | 4/1959 | Milton | 252/455 |
| 3,390,092 | 6/1968 | Keast et al. | 252/99 |
| 3,957,967 | 5/1976 | L'Orange | 252/102 |
| 4,219,435 | 8/1980 | Biard et al. | 252/174 |

FOREIGN PATENT DOCUMENTS

| | | |
|---|---|---|
| 2358249 | 5/1974 | Fed. Rep. of Germany . |
| 2350295 | 4/1975 | Fed. Rep. of Germany . |
| 2434309 | 5/1975 | Fed. Rep. of Germany . |
| 2602357 | 7/1976 | Fed. Rep. of Germany . |
| 2913145 | 4/1979 | Fed. Rep. of Germany . |
| 2857001 | 10/1979 | Fed. Rep. of Germany . |
| 1472680 | 1/1967 | France . |

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

A process for the production of tablet form detergent compositions is afforded, comprising:

(a) the partial hydration of from 10 to 60 parts by weight of an anhydrous sodium polyphosphate to form from 30 mole percent to less than 80 mole percent of tripolyphosphate hexahydrate;

(b) mixing the partial hydrate with from 20 to 70 parts by weight of a powder-form, substantially anhydrous sodium silicate ($Na_2O$: $SiO_2$=1:1 to 1:4);

(c) spraying the mixture with water or an aqueous silicate solution; and (d) granulation by agitation, followed by crystallization, other detergent ingredients optionally being added along with bleaches or enzymes, and adding from 1 to 5% by weight of sodium acetate or from 0.5 to 3% by weight of dicalcium phosphate dihydrate or a mixture thereof as a tableting aid, followed by tableting under a pressure of more than 70 kp/cm$^2$, leading to mechanically strong, but rapidly dissolving tablet form detergent compositions.

19 Claims, No Drawings

PROCESS FOR THE PRODUCTION OF TABLET FORM DETERGENT COMPOSITIONS

BACKGROUND OF THE INVENTION

1. Field of the Invention

This invention relates to a process for the production of tablet form detergent compositions, more particularly for use in dishwashing machines.

2. Statement of the Prior Art

Powder form, granular or tablet form detergent compositions for crockery in dishwashing machines consist essentially of sodium tripolyphosphate, alkali silicate, generally alkali metasilicate, and optionally of a low-foam, preferably chlorine stable, nonionic surfactant and also bleaching agents, preferably of the type which give off chlorine in aqueous solution. Their primary function is to facilitate the removal of stains left by tea, coffee or fruit juices.

The compositions are strongly alkaline because of their high content of alkali silicates and sodium tripolyphosphate. The solutions in which they are used have a pH value of from about 11 to 12. The compositions do not contain any additions of sodium hydroxide because, in view of the contact times normally necessary in domestic dishwashing machines, the excessive alkalinity would attack porcelain glazed on decorations and glasses. This aggressive effect is known as corrosion. By contrast, silicate synergistically supports the cleansing power of the tripolyphosphate and, in certain concentrations in the tripolyphosphate/silicate mixture, inhibits corrosion.

The known comspositions are generally produced by standard methods, such as mixing or granulation. They are used in powder form or granulate form, again in standard concentrations, i.e. in quantities of from about 30 to 50 g (about 1 to 1.75 oz.) per machine load.

Powder form or granular compositions of this type are described, for example, in German Patent Application Nos. 23 50 295 (corresponding to British No. 1,442,885); 23 58 249 (corresponding to U.S. Pat. Nos. 3,816,320 and 3,936,386); 29 13 145; 24 34 309 (corresponding to U.S. Pat. No. 3,933,670); and 26 02 357 (corresponding to U.S. Pat. No. 4,083,795).

According to French Pat. No. 1,472,680, (corresponding to U.S. Pat. No. 3,390,092) circular tablets, for example having a diameter of 3 cm, a thickness of 1.2 cm and a weight of about 12 g (from which a density of more than 1.4 g/cc can be calculated) may be produced from simple mixtures of known detergent ingredients in conjunction with a tableting aid using pressures of from about 70 to 1000 kg/cm$^2$. About four of these tablets give substantially the same result as a powder form detergent filling of 50 g per machine load.

Tablets of the type mentioned above are also described in German patent application No. 28 57 001 (corresponding to U.S. Pat. No. 4,219,436). They are also obtained by compressing simple mixtures of the constituents under appropriate pressures. In this case, alkalinity is determined not through the pH value, but instead by ascertaining how much N-hydrochloric acid is necessary to reduce the pH value of a solution of 100 g of the detergent composition in water to pH 9 and comparing the quantity of sodium hydroxide dissolved in the same quantity of water which is required for the same quantity of N-hydrochloric acid. The result is expressed as the "alkalinity equivalent". In the case of the known dishwashing compositions, the values are generally above 15 g of NaOH, based on 100 g of detergent composition.

The particular pressure level and the resulting density of the tablets are always determined by the necessary compromise between the strength and dissolving rate of the tablets. Other factors affecting those properties are the nature of the constituents themselves and suitable tableting aids.

DESCRIPTION OF THE INVENTION

It has now surprisingly been found that tablet form detergent compositions for dishwashing machines distinguished not only by high mechanical strength, but above all by a high dissolving rate can be obtained if, in the production of the compositions, the ingredients showing an alkaline reaction are first granulated and then compressed, optionally in admixture with other constituents, after the addition of tableting aids. Pressures of more than 70 kp/cm$^2$ (kiloponds per square centimeter) are applied. A kilopond/cm$^2$ is equal to a kilogram/cm$^2$.

A particularly suitable granulating and mixing process which precedes the process according to the invention for producing the tablets is described in detail in German patent application No. 29 13 145, an English translation of which is of record.

Accordingly, the present invention preferably relates to a process for producing tablet form alkaline dishwashing preparations of known composition suitable for use in dishwashing machines using pressures of more than 70 kp/cm$^2$. According to this invention, a completely crystallized granulate having a powder density of from 800 to 1200 g/l and preferably from 850 to 1100 g/l, is obtained by the following sequential steps.

(a) Partially hydrating from 10 to 60 parts by weight and preferably from 25 to 40 parts by weight of an anhydrous sodium tripolyphosphate, of which 60 to 100% consists of a tripolyphosphate of phase II and which has an average grain size of from 0.05 to 0.5 mm, for 0.2 to 5 seconds (average residence time) in a continuous mixer (first mixing stage) with a quantity of water sufficient to form from 30 mole percent to less than 80 mole percent of tripolyphosphate hexahydrate, accompanied by mechanical treatment of the mixture in such a way that at least 85% by weight thereof has a grain size above 0.2 mm and less than 2% by weight a grain size below 0.1 mm;

(b) Mixing the partial hydrate with from 20 to 70 parts by weight and preferably with from 30 to 50 parts by weight of a powder form, substantially anhydrous sodium silicate consisting of $Na_2O$ and $SiO_2$ in a ratio of from 1:1 to 1:4, optionally in conjunction with up to 25 parts by weight of a granulating aid, in a granulation mixer (second mixing stage after a residence time outside the mixer of from 5 to 60 seconds, followed by spraying with water or with an aqueous solution of from 0.5 to 5 parts by weight of sodium silicate solution in from 2 to 12 parts by weight and preferably from 5 to 12 parts by weight of water;

(c) Granulating the product by agitation, followed by thorough crystallization;

(d) Optionally adding other detergent ingredients, along with bleaches and enzymes;

(e) Adding tableting aids; and (f) Introducing the product mixture into the bores of a tableting machine and forming tablets.

As used herein, all percentages by weight are based upon the weight of the entire product.

Other granulating aids, such as anhydrous sodium carbonate or bicarbonate, sodium hydroxide or waterglass, and also water, paraffin oil (which may also serve as a foam suppressor), and/or low foaming nonionic surfactants, may be added at the same time as or after the solid sodium silicate. However, the quantity of surfactant added should be limited to between 0.1 and 2% by weight and preferably to between 0.2 and 0.5% by weight because, on introduction of the tablets into the dishwashing machine, undesirable foaming might otherwise occur in conjunction with the various types of soil to be removed.

Suitable low foaming nonionic surfactants are the known ethoxylation products of long chain alcohols and alkyl phenols, the free hydroxyl group of the polyethylene glycol ether residue being substituted by ether or acetal groups or by polypropylene glycol ether residues in order to reduce the tendency towards foaming. Block copolymers of ethylene oxide with propylene oxide are also suitable.

Suitable bleaches are compounds which give off active oxygen, such as perborates, preferably in conjunction with bleach activators, such as for example tetraacetyl ethylene diamine (TAED) or tetraacetyl glycol uril (TAGU) or peracids or their salts, for example the magnesium salt of monoperphthalic acid. However, it is preferred to use compounds which give off active chlorine, such as the salts of chlorine substituted isocyanuric acids, particularly pure trichloroisocyanuric acid itself. They are optionally used in quantities of from 0.5 to 5% by weight and preferably in quantities of from 1 to 3.5% by weight, based on the mixture to be tableted.

If no bleaches are added, enzymes may be used for improving cleansing power, preferably commercially available amylases in quantities of from 0.2 to 2% by weight and preferably in quantities of from 0.5 to 1% by weight.

The external appearance of the detergent compositions may be further improved by dyeing part of the bleach free granulate with bleach stable dyes or pigments, such as phthalocyanine for example, and subsequently adding the dyed granulate to the rest of the granulate, for example together with the bleaches. Fragrances, known bactericides, soil suspending agents and corrosion inhibitors may also be added.

The prepared granulate may be mixed with the remaining ingredients of the detergent composition in conventional mixers.

The tableting aids added to the prepared granulate-containing mixture are, preferably, sodium acetate in quantities of from 1 to 5% (preferably from 2 to 3%) by weight and/or dicalcium phosphate dihydrate in quantities of from 0.5 to 3% (preferably from 0.8 to 1.2%) by weight, based in either case on 100% of the granulate to be tableted as a whole. However, other known agents which improve the compressibility of the preparations and the dissolution of the tablets in the machine, may also be added. Other known agents such as these include nonsurface-active alkali salts of monobasic to tribasic organic carboxylic acids, for example citrates, formates, benzoates, tartrates, oxalates and the like.

The granulate mixture thus prepared may be readily compressed into any shape. Prismatic tablets of hexagonal cross section are preferred. Their volume is determined by a desired weight of the tablet of around 20 g.

No deposits were found to accumulate on the tableting tools. The tablets obtained were found to dissolve satisfactorily, even after prolonged storage.

The granulate mixture may be tableted using any known eccentric and rotary presses of the type suitable for producing tablets having a diameter of approximately 1.0 cm and larger. Where the composition of the tablets is determined in advance, the pressure applied has to be optimized in such a way that, for a given weight, the tablets obtained are, on the one hand, stable enough not to be damaged during packaging and transport but, on the other hand, dissolve sufficiently quickly in the machine. This optimum pressure is readily determined by one skilled in the art by trial and error in the usual way. The density of the tablets is then a consequence of the tableting pressure applied for a given mixture. A pressure of from 800 to 1500 kp/cm$^2$ and preferably from 950 to 1050 kp/cm$^2$ has proved optimal for tableting the ingredients of the composition according to the invention.

The tablets obtained by this process have an average density of 1.4 g/cc and, in addition to high mechanical stability, show a uniform porous structure with a large inner surface. Accordingly, they dissolve particularly quickly when used in dishwashing machines and may be flushed into the machine more quickly than the granular detergent composition used for tableting.

The tablets according to the invention may contain other inorganic phosphate substitutes in combination with the phosphate used. Preferred inorganic phosphate substitutes are the synthetic zeolites of the NaA or NaX type which are described, for example, in U.S. Pat. Nos. 2,882,243 and 2,882,244. They are used in quantities of from 3 to 30% by weight and preferably in quantities of from 5 to 10% by weight and added in the second mixing stage. In addition to the boosting effect which they have on cleansing, the zeolites show an additional corrosion inhibiting effect on decorative glazes applied to porcelain or ceramics which exceeds that of the known tripolyphosphate/metasilicate mixtures. In addition to mechanical stability, the tablets according to the invention also show outstanding chlorine stability although they have a water content of the order of 10% by weight.

EXAMPLES ACCORDING TO THE INVENTION

EXAMPLE 1

41.7% by weight of anhydrous sodium metasilicate and 38.6% by weight of sodium tripolyphosphate were granulated with 4.0% by weight of waterglass 37/40 and 0.2% by weight of white paraffin oil having a flash point of 210° C. in the presence of 6.7% by weight of anhydrous sodium carbonate by the process described in detail in German Patent Application No. 29 13 145 and the resulting granulate mixed in a mixer of the lödige-type with 3.0% by weight of the same granulate dyed blue by the addition of phthalocyanine ("blue speckles"), 1.0% by weight of trichloroisocyanuric acid, 2.0% by weight of sodium acetate and 1.0% by weight of dicalcium phosphate dihydrate. Quantities of 20 g of this mixture were continuously introduced one after the other through a feed hopper into a regular hexagonal matrix bore of an eccentric tableting machine of the Exakta 31 type manufactured by the Fette Company and tableted under a pressure of 1000 kp/cm$^2$ to form tablets having a density of the order of 1.4 g/cc.

The tablets obtained were characterized by a fine, uniform grain structure and by high stability. Their flush-in time into a domestic washing machine through a grid covered measuring box of the G 5035 type of the Miele Company was 25 minutes, i.e. 2 minutes less than the time taken to flush in the same quantity by weight of the same, but non-tableted detergent composition without the tableting aid.

EXAMPLES 2 to 6

Other tablets were produced in the same way as in Example 1, their composition, characteristics and properties being shown in the following Table.

TABLE

| Composition | Example No. | | | | |
|---|---|---|---|---|---|
| % by weight | 2 | 3 | 4 | 5 | 6 |
| (a) Granulate of | | | | | |
| Sodium metasilicate, anhydrous | 44.1 | 44.1 | 46.3 | 41.4 | 40.0 |
| Sodium tripolyphosphate | 36.6 | 36.6 | 34.3 | 38.0 | 32.0 |
| Sodium carbonate, anhydrous | 6.7 | 6.7 | 6.7 | 6.6 | 6.4 |
| Waterglass 37/40 | 4.0 | 4.0 | 4.0 | 3.9 | 3.8 |
| White paraffin oil | 0.3 | 0.5 | 0.5 | 0.5 | 0.5 |
| Zeolite NaA | — | — | — | — | 5.0 |
| Water | balance | balance | balance | balance | balance |
| (b) Addition of | | | | | |
| Sodium acetate | 2.0 | 2.0 | 2.0 | 2.0 | 2.0 |
| Dicalcium phosphate dihydrate | 1.0 | 1.0 | 1.0 | 1.0 | 1.0 |
| "Blue speckles" | 3.0 | 3.0 | 3.0 | 3.0 | 3.0 |
| Trichloroisocyanuric acid | 1.0 | 1.0 | 1.0 | 1.0 | 1.0 |
| "Alkalinity equivalent" in g of NaOH/100 g of detergent | 27.37 | 19.96 | 21.8 | 27.56 | 26.63 |
| Density in g/cc | 1.4082 | 1.4061 | 1.420 | 1.3968 | 1.4112 |
| Weight in g | 19.95 | 19.89 | 20.60 | 19.60 | 20.05 |
| Flush-in time, tablet (in minutes) | 21 | 24 | 26 | 22 | 25 |
| Flush-in time, granulate (in minutes) | 26 | 28 | 30 | 29 | 31 |

We claim:

1. In a process for manufacturing detergent compositions in tablet form by mixing the ingredients and then tableting the mixture, the improvement comprising the sequential steps of:

hydrating partially from about 10 to 60 parts by weight of an anhydrous sodium tripolyphosphate with a sufficient quantity of water to form from about 30 mole percent to less than about 80 mole percent of tripolyphosphate hexahydrate;

mixing said partial hydrate after a residence time of from about 5 to 60 seconds with from about 20 to 70 parts by weight of a powder form, substantially anhydrous, sodium silicate consisting essentially of $Na_2O$ and $SiO_2$ in a ratio of from 1:1–4, followed by spraying with water or with an aqueous sodium silicate solution; and granulating the product by agitation, followed by crystallization;

adding tableting aids and any remaining ingredients desired to the granulate and further mixing; said tableting aids consisting essentially of sodium acetate in a quantity of about 1 to 5% by weight, dicalcium phosphate dihydrate in a quantity of 0.5 to 3% by weight, or a mixture thereof, all based upon the weight of the entire composition to be tableted; and tableting the composition under pressures of more than 70 $Kg/cm^2$.

2. The process of claim 1, wherein said granulate is completely crystallized and has a powder density of from about 800 to 1200 g/l.

3. The process of claim 2, wherein said granulate has a powder density of from about 850 to 1100 g/l.

4. The process of claim 2, wherein said granulate has a powder density of from about 850 to 1100 g/l.

5. The process of claim 1 wherein said remaining ingredients desired are mixed with said granulate along with bleaches or enzymes, the tableting aids are added and mixed to constitute the final composition, and said final composition is tableted.

6. The process of claim 1 wherein said sodium acetate, is present it is in a quantity of about 2 to 3% by weight and when said dicalcium phosphate dihydrate is present it is in a quantity of about 0.8 to 1.2% by weight, all based on the weight of the entire composition to be tableted.

7. The proces of claim 1 wherein the tableting pressure is from about 800 to 1500. $Kg/cm^2$.

8. The process of claim 1 wherein the tableting pressure is from about 950 to 1050 $Kg/cm^2$.

9. The process of claim 1 wherein coloring constituents are added as further detergent ingredients.

10. The process of claim 3 wherein: said remaining ingredients desired are mixed with said granulate along with bleaches or enzymes; said tableting aids are added and mixed to constitute the final composition and are sodium acetate present in an amount of 2 to 3% by weight, dicalcium phosphate dihydrate present in an amount of 0.8 to 1.2% by weight, or a mixture thereof, all based on the weight of the entire composition to be tableted; said tableting pressure is from 950 to 1050; $Kg/cm^2$ and coloring constituents are added as further ingredients.

11. A detergent composition in tablet form which is the product of the manufacturing process of claim 1.

12. A detergent composition in tablet form which is the product of the manufacturing process of claim 2.

13. A detergent composition in tablet form which is the product of the manufacturing process of claim 3.

14. A detergent composition in tablet form which is the product of the manufacturing process of claim 5.

15. A detergent composition in tablet form which is the product of the manufacturing process of claim 6.

16. A detergent composition in tablet form which is the product of the manufacturing process of claim 7.

17. A detergent composition in tablet form which is the product of the manufacturing process of claim 8.

18. A detergent composition in tablet form which is the product of the manufacturing process of claim 9.

19. A detergent composition in tablet form which is the product of the manufacturing process of claim 10.

* * * * *